US005730277A

United States Patent [19]

Meinke et al.

[11] Patent Number: 5,730,277

[45] Date of Patent: Mar. 24, 1998

[54] APPARATUS FOR TRANSFERRING ROD-SHAPED ARTICLES OF THE TOBACCO PROCESSING INDUSTRY FROM A STATIONARY GUIDE TO A CONVEYOR

[75] Inventors: Karsten Meinke; Jens Collin, both of Hamburg; Nikolaos Georgitsis, Lübbecke, all of Germany

[73] Assignee: Topack Verpackungstechnik GmbH, Schwarzenbek, Germany

[21] Appl. No.: 797,935

[22] Filed: Feb. 12, 1997

[30] Foreign Application Priority Data

Feb. 28, 1996 [DE] Germany ..... 196 07 419.3

[51] Int. Cl.[6] ..... B65G 15/58

[52] U.S. Cl. ..... 198/468.6; 131/84.1; 131/94; 131/281; 131/282

[58] Field of Search ..... 131/281, 280, 131/282, 283, 94, 84.1, 84.2; 53/148, 151, 150, 149; 198/458, 482.1, 605, 483.1, 468.6; 221/176, 123, 180, 200

[56] References Cited

U.S. PATENT DOCUMENTS

| | | | |
|---|---|---|---|
| 4,258,528 | 3/1981 | Focke | 53/473 |
| 4,342,321 | 8/1982 | Zullo | 131/282 |
| 4,612,756 | 9/1986 | Focke et al. | 53/579 |
| 4,947,872 | 8/1990 | Gambevini | 131/28.3 |
| 5,201,162 | 4/1993 | Focke | 53/150 |
| 5,464,027 | 11/1995 | Bina et al. | 131/283 |
| 5,536,118 | 7/1996 | Schmidt et al. | 406/68 |

*Primary Examiner*—V. Millin
*Assistant Examiner*—Charles W. Anderson
*Attorney, Agent, or Firm*—Darby & Darby

[57] ABSTRACT

Successive block-shaped arrays of cigarettes are advanced by one or more pushers on an endless conveyor through an elongated channel, defined by a stationary guide, on their way into a receptacle of a wrapping unit for the arrays. The pusher or pushers are decelerated during advancement through the discharge end of the channel, and the arrays are braked during such deceleration to maintain them in uninterrupted contact with the pusher or with the respective pushers until the arrays complete their movement into a predetermined portion of the receptacle. For example, the arrays can be braked by one or more mechanical devices and/or by one or more pneumatic devices.

19 Claims, 4 Drawing Sheets

APPARATUS FOR TRANSFERRING ROD-SHAPED ARTICLES OF THE TOBACCO PROCESSING INDUSTRY FROM A STATIONARY GUIDE TO A CONVEYOR

BACKGROUND OF THE INVENTION

The invention relates to improvements in apparatus for manipulating groups of smokers' products, such as arrays of plain or filter cigarettes, cigarillos, cigars, cheroots or other rod-shaped smokers' products, particularly in packing machines which serve to turn out packets (e.g., hinged lid packets) of rod-shaped smokers' products.

More particularly, the invention relates to improvements in apparatus for transferring successive groups of smokers' products (e.g., unwrapped, partially wrapped or wrapped arrays of twenty cigarettes each) from a stationary part (such as a channeled or tunneled guide) into one or more receptacles (e.g., pockets) of a mobile conveyor.

It is known to transfer successive groups or arrays (hereinafter called groups) of rod-shaped smokers' products from a path which is defined by a stationary guide into one or more receptacles of a conveyor, e.g., for the purpose of completing the wrapping or draping of successive (partially confined) groups into one or more blanks consisting of paper, metallic foil and/or a suitable synthetic plastic sheet material. The transfer is often carried out by pushers which are moved at different speeds during different stages of advancement of groups in the guide and in the receptacle. As a rule, the pusher is decelerated during the last stage of the transfer of a group from the guide into the receptacle in a cigarette packing machine or the like. This can create serious problems if a group is caused to advance by inertia forwardly and away from actual contact with the pusher while the speed of the pusher is on the decrease because the pusher is unable to reliably advance the group to a predetermined optimum position within the receptacle, for example, to a position in which the draping or wrapping of the group into one or more blanks is to be initiated, contained and/or completed. The inability of a pusher to advance a group to an optimum position in the receptacle of a conveyor in a packing machine prevents the folding or wrapping instrumentalities from properly engaging and deforming the blank or blanks which is or which are to constitute the inner and/or outer envelopes of groups, for example, before the thus draped groups are to be introduced into prefabricated hinged-lid packs or soft packs or before the thus draped groups are properly positioned relative to blanks which are to be converted into soft packs or hinged-lid packs.

OBJECTS OF THE INVENTION

An object of the invention is to provide a novel and improved apparatus which can reliably advance each of a short or long series of groups of smokers' products from a first position to a second position, particularly from a stationary guide or support into one or more receptacles of a conveyor in a machine for making and filling packets for arrays of plain or filter cigarettes, cigars, cigarillos, cheroots and/or other rod-shaped articles of the tobacco processing industry.

Another object of the invention is to provide an apparatus which can reliably advance successive groups to predetermined positions even if the speed of the means for advancing such groups varies within a wide range.

A further object of the invention is to provide an apparatus which can reliably prevent undesirable movements of groups by inertia and/or undesirable premature stoppage of the groups on their way from a stationary support onto a conveyor or other moving means.

An additional object of the invention is to provide an apparatus which can be used with advantage to advance successive groups of smokers' products between a first location where the groups are caused to advance at a first speed (e.g., zero speed) and a second location where the groups are caused to advance at a second speed (e.g., an elevated speed).

Still another object of the invention is to provide the apparatus with novel and improved means for counteracting the inertia of moving groups of smokers' products during certain stages of manipulation of such groups in a packing machine or the like.

A further object of the invention is to provide a novel and improved apparatus for the manipulation of partially draped arrays of plain or filter cigarettes or other rod-shaped articles of the tobacco processing industry.

Another object of the invention is to provide a novel and improved method of transferring groups of smokers' products from a stationary support to a continuously or intermittently driven conveyor in a packing machine for arrays of plain or filter cigarettes or the like.

An additional object of the invention is to provide a packing machine for cigarettes or other rod-shaped articles of the tobacco processing industry which embodies one or more apparatus of the above outlined character.

Still another object of the invention is to provide a novel and improved guide or support for groups of rod-shaped articles of the tobacco processing industry which can be utilized in the above outlined apparatus.

A further object of the invention is to provide an apparatus which can be utilized with advantage for the manipulation of partially wrapped or draped groups or arrays of plain or filter cigarettes or the like as well as for the efficient manipulation of undraped groups or arrays of such rod-shaped articles.

SUMMARY OF THE INVENTION

The invention is embodied in an apparatus for manipulating groups of articles of the tobacco processing industry, particularly for manipulating block-shaped arrays of wrapped or partially wrapped or unwrapped plain or filter cigarettes, cigars, cigarillos or other smokers' products. The improved apparatus comprises a guide (particularly a stationary guide) which defines a preferably straight elongated path for the advancement of successive groups of a series of groups in a predetermined direction, at least one mobile receptacle (such as a pocket) for a group of articles, the receptacle being movable into and from a group-receiving position at the discharge end of path defined by the guide, means for advancing successive groups of the series of groups along the path in the predetermined direction into and beyond the discharge end of the path and into the receptacle while such receptacle assumes the group-receiving position relative to the guide, means for moving the advancing means at a plurality of speeds including a decreasing speed during introduction of a group into the receptacle at the discharge end of the aforementioned path, and means for braking the groups in the path at least during movement of the advancing means at the aforementioned decreasing speed.

The system which controls and initiates the movements of the receptacle relative to the guide is preferably designed in such a way that the receptacle is movable toward and away from the discharge end of the path substantially in and counter to the predetermined direction.

The advancing means can comprise one or more pushers or the like, and the means for moving the advancing means can comprise an endless belt or chain conveyor or analogous means for moving the pusher or pushers along the predetermined path in the predetermined direction toward and beyond the discharge end of the path.

The guide can be designed in such a way that it includes at least one wall which flanks the predetermined path, and the braking means can include means for establishing a predetermined frictional engagement between the at least one wall of the guide and a group being engaged by the advancing means while the advancing means is moved at the decreasing speed.

In accordance with a presently preferred embodiment, the braking means comprises at least one suction port which is provided in the guide. For example, the guide can comprise a wall which is disposed beneath the discharge end of the predetermined path, and the at least one suction port can be provided in such wall.

The path which is defined by the guide can have a variable cross-sectional area at its discharge end, and the braking means can include means for varying the cross-sectional area of the path. This guide can include a mobile wall (such as an elastically deformable wall) which is disposed above the discharge end of the path, and the means for varying can include means for moving the wall relative to a group at the discharge end of the path. Such braking means can further include at least one suction port in the wall of the guide.

The apparatus can further comprise means for temporarily coupling the guide with the receptacle when the latter has completed its movement toward the discharge end of the predetermined path. For example, the coupling means can comprise at least one projection provided on the guide at the discharge end of the path and a complementary recess provided in the receptacle and receiving the at least one projection upon completion of the movement of the receptacle toward the discharge end of the path. The guide can include a wall which is disposed beneath the discharge end of the path, and the at least one projection can be provided on such wall. The braking means can comprise at least one suction port which is provided in the at least one projection.

The positions of the at least one projection and of the recess(es) can be reversed, i.e., the receptacle can ne provided with at least one projection and the guide is then provided with at least one recess for the at least one projection of the receptacle.

The guide can include a first wall which is disposed beneath the discharge end of the path and at least one second wall which is laterally adjacent the discharge end. The coupling means of an apparatus which employs such guide can comprise at least one projection provided on at least one of the aforementioned walls and extending into a recess of the receptacle when the latter has completed its movement toward the discharge end of the predetermined path.

The braking means of the improved apparatus can comprise a plurality of braking devices. For example, such devices can include a pneumatic braking device (with one or more suction ports in the guide) and a mechanical braking device which can regulate the friction between the guide and a group advancing toward or in the receptacle while the speed of the advancing means is on the decrease.

The mechanical braking device (and/or another braking device) of the improved apparatus can be designed to constitute a means for arresting selected (e.g., unsatisfactory) groups of articles in the path to prevent the transfer of such selected groups into the receptacle.

In each embodiment of the improved apparatus, the braking means is or can be designed in such a way that it prevents an advancement of groups by inertia away from and out of contact with the advancing means during movement of the advancing means at the decreasing speed. This ensures that the advancing means can move each group to a predetermined optimum position in the pocket or receptacle.

The novel features which are considered as characteristic of the invention are set forth in particular in the appended claims. The improved apparatus itself, however, both as to its construction and its mode of operation, together with numerous additional important features and advantages thereof, will be best understood upon perusal of the following detailed description of certain presently preferred specific embodiments with reference to the accompanying drawings.

DESCRIPTION OF PREFERRED EMBODIMENTS

Figure 1:
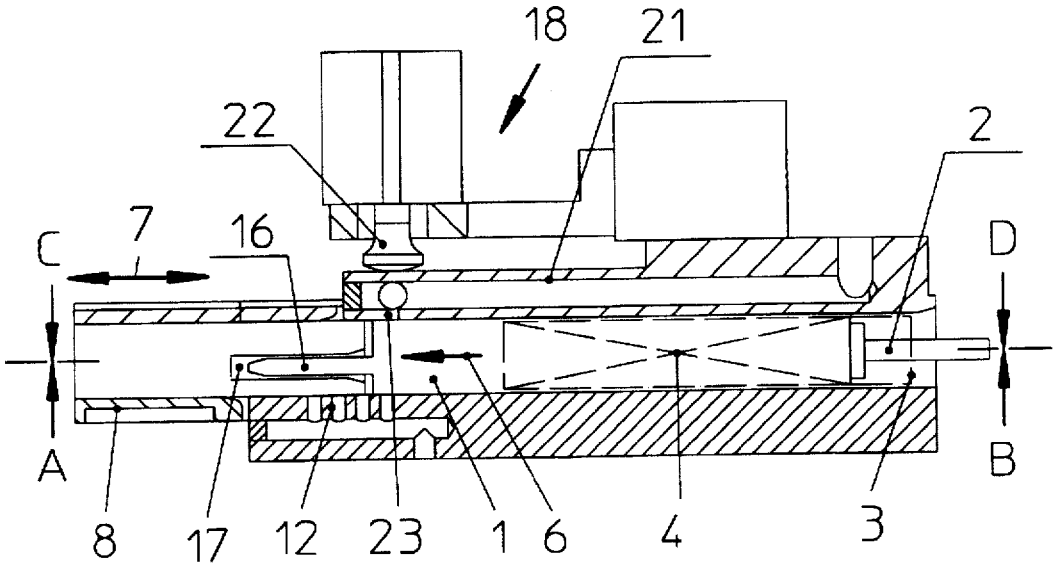
FIG. 1 is a somewhat schematic fragmentary longitudinal vertical sectional view of an apparatus which embodies the invention, which can be utilized for the manipulation of at least partially wrapped or unwrapped groups of smokers' products, and wherein the braking means for the groups comprises a pneumatic braking device and a mechanical braking device.

The apparatus which is shown in the drawings forms part of a complete line for the making of soft cup or hinged-lid packets containing arrays of cigarettes, cigars, cigarillos, cheroots or other rod-shaped articles of the tobacco processing industry. For example, the apparatus of FIGS. 1 to 5*d* can form part of a machine for the making of packets which contain arrays of twenty plain or filter cigarettes in the so-called quincunx formation. Production lines of such character are known as Topack machines and are distributed by the assignee of the present application.

Figure 2:
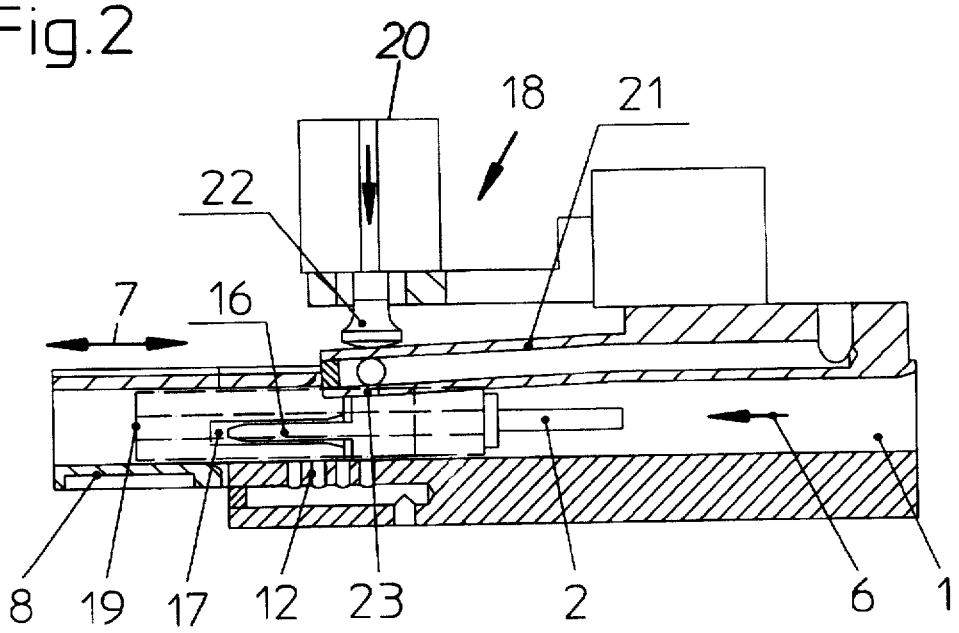
FIG. 2 is a view similar to that of FIG. 1 but with the mechanical braking device shown in the process of reducing the cross-sectional area of the discharge end of the path which is defined by the stationary guide for groups of smokers' products.
Figure 3:
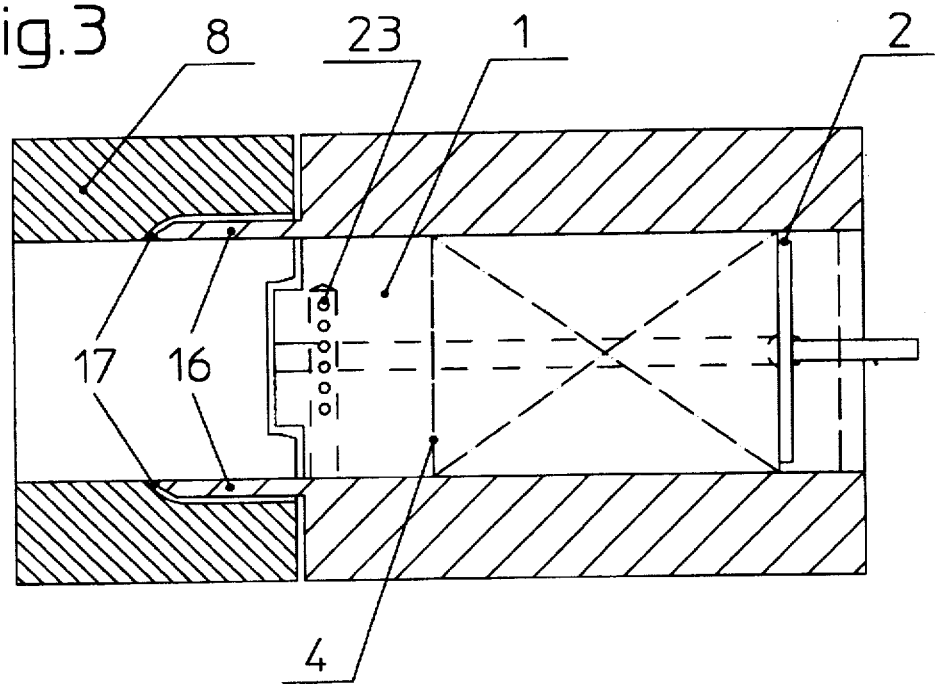
FIG. 3 is a sectional view substantially as seen in the direction of arrows from the line A–B in FIG. 1.

The improved apparatus comprises a stationary support or guide 1 which defines an elongated straight path (e.g., in the form of a straight flat channel having a rectangular cross-sectional outline) for successive groups 4 of rod-shaped articles (hereinafter called cigarettes). Each group 4 is expected to be confined in an envelope 3 which is still open at its rear or trailing end (namely the right-hand end as seen in each of FIGS. 1 to 5*d*). The means for advancing successive groups 4 of the series along the path which is defined by the guide 1 includes a series of equidistant pushers 2 which are secured to an endless conveyor 11 serving as means for moving the pushers 2 at a plurality of different speeds including a decreasing speed when a pusher is in the process of moving through the discharge end of the path and into the receptacle 8 which is then located adjacent such discharge end. FIG. 1 shows that the receptacle 8 (such as a pocket open at its left-hand and right-hand ends) is adjacent the discharge end of the path in the guide 1, and FIG. 2 illustrates the same receptacle in the process of receiving a group 4 because the pusher 2 for such group is still in the process of moving in the direction of the arrow 6, namely toward and into the discharge end of the path. The head of such pusher extends into the open envelope 3 to engage the rear ends of the cigarettes forming part of the respective group 4 or the rear end of an inner envelope for the group of cigarettes. The envelope 3 can constitute a converted blank of metallic foil or another suitable sheet material.

The receptacle 8 is movable relative to the discharge end of the path defined by the stationary guide 1 in the directions indicated by a double-headed arrow 7; when the movement of the illustrated receptacle in the direction to the right (as viewed in the drawings) is completed, the receptacle is in an optimum position to receive an oncoming block-shaped group 4 which is being advanced by the pusher at a speed being determined by the conveyor 11.

The bottom wall of the guide 1 (i.e., the wall which is located beneath the path for the groups 4) is provided with means for braking successive groups at the discharge end of such path, namely at a time when a single pusher 2 or two or more pushers is or are being decelerated by the endless conveyor 11 so that, in the absence of a braking action, the group 4 would be likely to advance by inertia forwardly and away from the head of the pusher. This would prevent the pusher from invariably locating the group 4 in an optimum position within the receptacle 8. Such optimum positioning is particularly important if a group which has entered the receptacle 8 is to undergo further manipulation, such as closing of the rear end of the envelope 3, introduction of the group into a soft cup or into a hard packet with or without a hinged lid, and/or other treatment or treatments.

The braking means which is embodied in the bottom wall of the guide 1 is a pneumatic braking device having a set of suction ports 12 connected to a suitable suction generating device (such as the intake end of a blower or fan, not specifically shown) by way of a suction chamber (see FIGS. 1, 2 and 5*a* to 5*d*) in the front portion of the bottom wall of the guide 1. Some of the suction ports 12 can be provided in one or more projections 13 (see particularly FIG. 4) forming part of the bottom wall and extending forwardly beyond the discharge end of the path in the guide 1. The projections 13 form part of means for temporarily coupling the guide 1 to the adjacent portion of the receptacle 8 which has completed its movement in a direction to the right (as viewed in the drawings), namely toward the discharge end of the path in the guide 1, and such coupling means further comprises recesses 14 provided in the receptacle 8 and preferably designed to snugly receive the projections 13 during advancement of a group 4 from the interior of the guide 1 into the receptacle 8 then occupying a requisite position at the discharge end of the aforementioned path.

Figure 4:
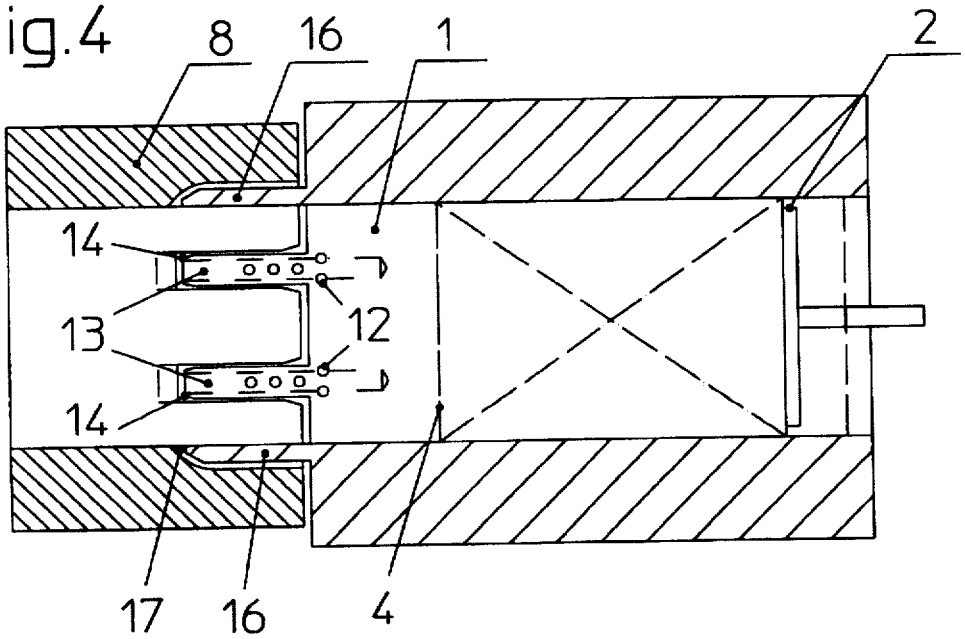
FIG. 4 is a sectional view substantially as seen in the direction of arrows from the line C–D in FIG. 1.

As can be seen in FIG. 4, the coupling means can further comprise one or more additional projections 16 provided in one or both sidewalls or lateral walls of the guide 1 (such walls flank the path for the groups 4) and snugly received in the adjacent portions of the receptacle 8 then occupying the prescribed group-receiving position at the discharge end of the path defined by the guide 1.

It is possible to provide the projection or projections on the pocket or receptacle 8 so that such projection or projections enters or enter a complementary recess or complementary recesses in the guide 1 when the receptacle is ready to receive a group 4.

The number of projections can be reduced to one, two or three or increased to five or more.

The means for braking the groups 4 during movement toward or into or in the pocket or receptacle 8 can comprise one or more braking devices. Thus, the braking device embodying the illustrated suction ports 12 and the means for drawing air from such ports (either continuously or in dependency on the speed of the conveyor 11 for the pusher 2) can be utilized in lieu of, or jointly with, or be replaced by a mechanical braking device 18 which is shown in FIGS. 1–3 and 5*a*–5*d* and can be designed to frictionally engage selected groups, e.g., groups 19 (one shown in FIG. 2) which are not confined in envelopes 3 and should not reach the receptacle 8 or should be expelled from the receptacle subsequent to advancement beyond the discharge end of the path defined by the stationary guide 1. The illustrated mechanical braking device 18 comprises a mobile (such as elastically deformable) top wall 21 of the guide 1 and a plunger 22 which can be connected to the reciprocable piston in a hydraulic or pneumatic cylinder 20 to deform (displace) the top wall 21 so that the latter reduces the cross-sectional area of the discharge end of the path defined by the guide 1 and its underside frictionally engages and brakes or actually arrests a defective or unsatisfactory group 19. The piston in the cylinder 20 can respond to signals transmitted by one or more suitable sensors (not shown) which monitor successive groups located in or ahead of the guide 1 and transmit signals in response to detection of groups 19.

The mechanical braking device 18 can include a pneumatic portion. Thus, and as can be best seen in FIG. 4, the mobile (deformable) top wall 21 of the guide 1 can be provided with suction ports 23 which are automatically connected to a discrete suction generating device or to the suction generating device for the ports 12 when the piston in the cylinder 20 receives a signal to depress the plunger 22, i.e., to move the top wall 21 into frictional engagement with the group 19 therebelow. The force-locking engagement between the deformable top wall 21 and a group 19 (in response to downward movement of the plunger 22) can be replaced by a purely pneumatic braking or arresting action by means of the suction ports 23. Furthermore, such suction ports 23 can replace the suction ports 12 and the plunger 22 is then designed to move the top wall 21 dowardly in dependency upon the variations of the speed of the pusher 2 which is in the process of delivering a group 4 into the receptacle 8 occupying a requisite position at the disacharge end of the path defined by the guide 1.

FIGS. 1, 2 and 5*a* to 5*d* show that the deformable top wall 21 defines a suction chamber which communicates with the suction ports 23 and is connectable with a suction generating device when necessary to activate the braking device 18 in order to arrest a group 19, to assist the pneumatic braking device including the suction ports 12 in braking the groups 4, or to replace the pneumatic braking device including the ports 12.

Figure 5A:
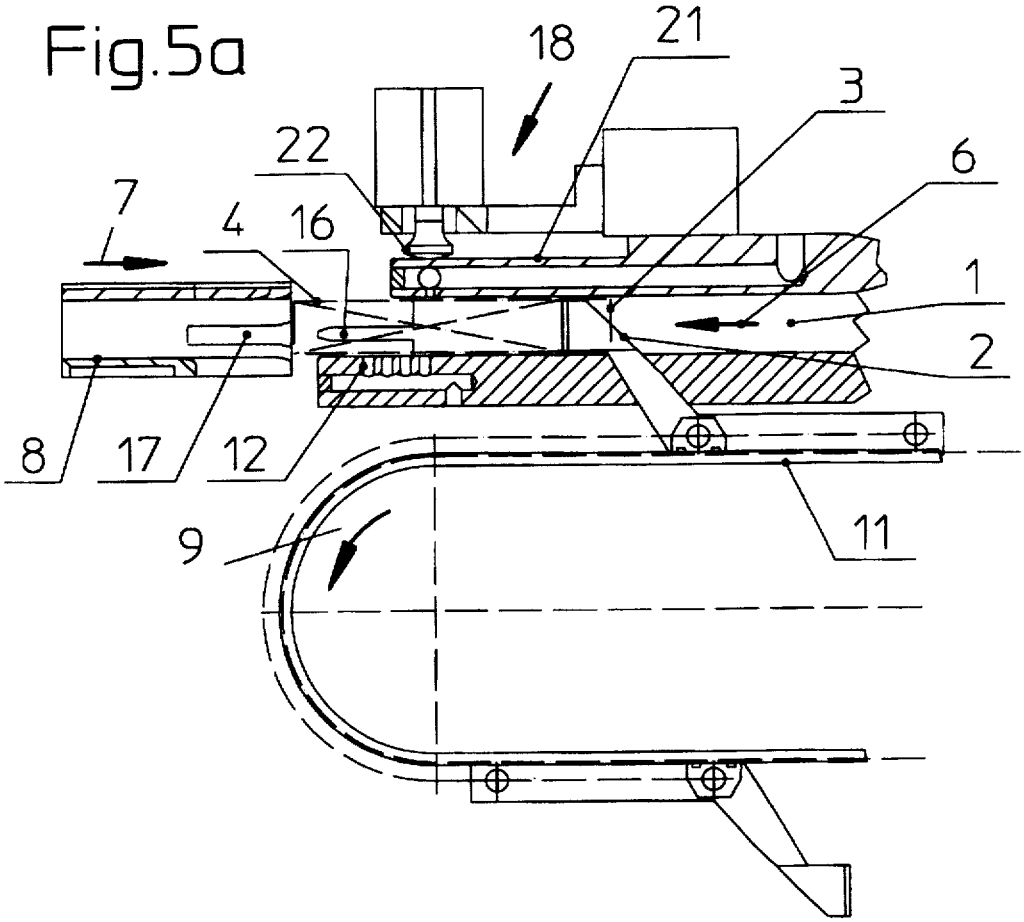
FIG. 5*a* is a smaller-scale fragmentary longitudinal vertical sectional view similar to that of FIG. 1 and further showing a portion of the means for moving the pusher(s) of the means for advancing successive groups of smokers' products along the elongated path which is defined by the stationary guide.

The mode of operation of the improved apparatus will now be described with reference to FIGS. 5*a* to 5*d* which show a group 4, the corresponding pusher 2 and the pocket or receptacle 8 in a series of different positions. As shown in FIG. 5*a*, a receptacle 8 is in the process of moving in a direction to the right toward the discharge end of the path defined by the stationary guide 1 but the recesses (FIG. 5*a* merely shows one of the recesses 17) are still spaced apart from the respective projections of the guide. The pusher 2 has advanced the group 4 partially beyond the discharge end of the path and the underside of the envelope 3 overlies the suction ports 12 in the bottom wall and the projections 13 of the guide 1. The head of the pusher 2 extends into the open rear end of the envelope 3 and engages the rear ends of the cigarettes in the group 4. The conveyor 11 is assumed to advance the pusher 2 at a decreasing speed in the direction of the arrow 9 and the suction ports 12 are connected to the suction generating device to ensure that the group 4 cannot advance (by inertia) forwardly and away from contact with the head of pusher 2. The suction ports 12 can be permanently connected with the suction generating device so that each of a series of successive groups 4 is braked as long as the respective envelope 3 is being caused to advance over (i.e., to overlie at least some of) these suction ports. It can be said that the braking device including the suction ports 12 holds successive groups 4 captive during advancement in and beyond the discharge end of the path in the guide 1 so that such groups advance forwardly at the exact speed of the respective pushers 2 until they reach the required positions in the pocket or receptacle 8. The illustrated receptacle is assumed to be open at the end which receives a group 4 from the guide 1 as well as at the opposite end.

Figure 5B:
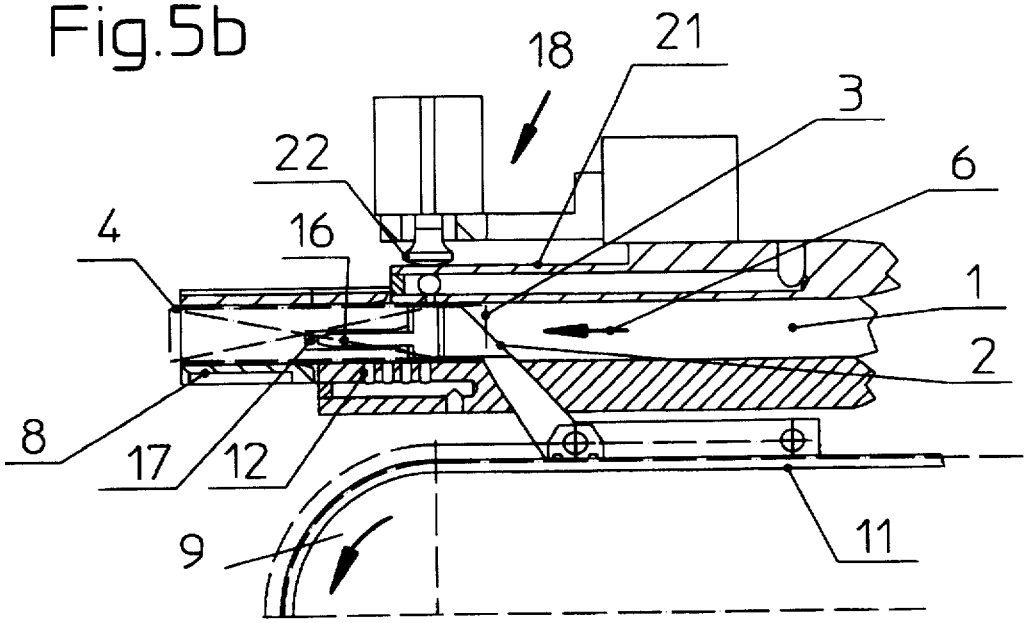
FIG. 5*b* is a view similar to that of FIG. 5*a* but showing a receptacle and one of the pushers in different positions relative to the stationary guide.
Figure 5C:
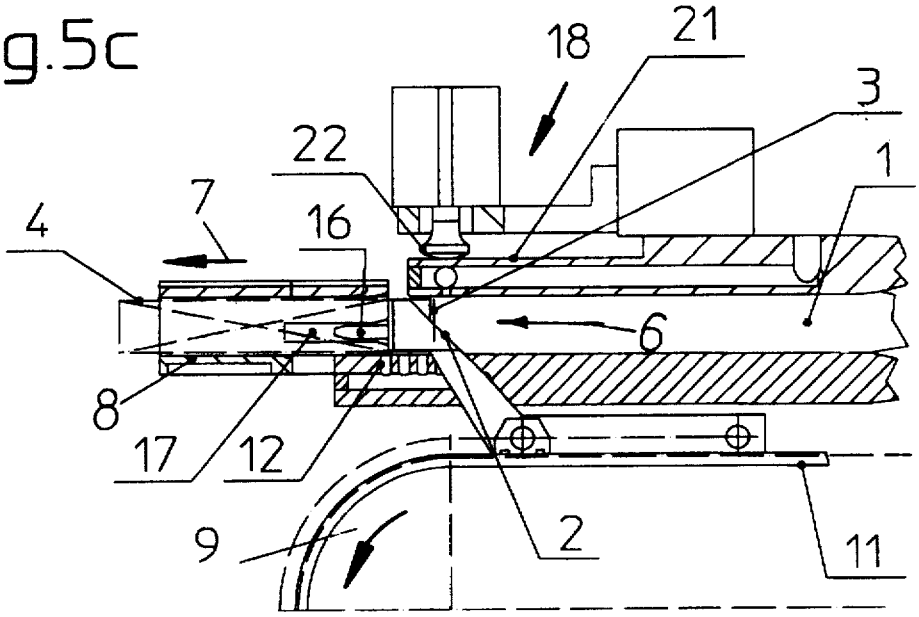
FIG. 5*c* shows the structure of FIG. 5*b* but with the receptacle and a pusher in different positions relative to the guide.

FIG. 5*b* shows the receptacle 8 of FIG. 5*a* in its right-hand end position in which the projections 13 and 16 of the guide 1 are received in the respective recesses 14 and 17 of such receptacle. The conveyor 11 moves the pusher 2 in the direction of the arrow 9 at a continuously decreasing speed and the suction ports 12 are effective to ensure that the group 4 remains in contact with the head of the pusher.

During the next stage of transfer of the group 4, the receptacle 8 moves away from the guide 1 (see FIG. 5*c*) and the moving pusher 2 continues to extend into the rear end of the envelope 3 and preferably remains in contact with the adjacent ends of cigarettes in such group. The receptacle 8 is being accelerated in a direction away from the guide and its speed approximates or temporarily matches the speed of the decelerated pusher 2.

Figure 5D:
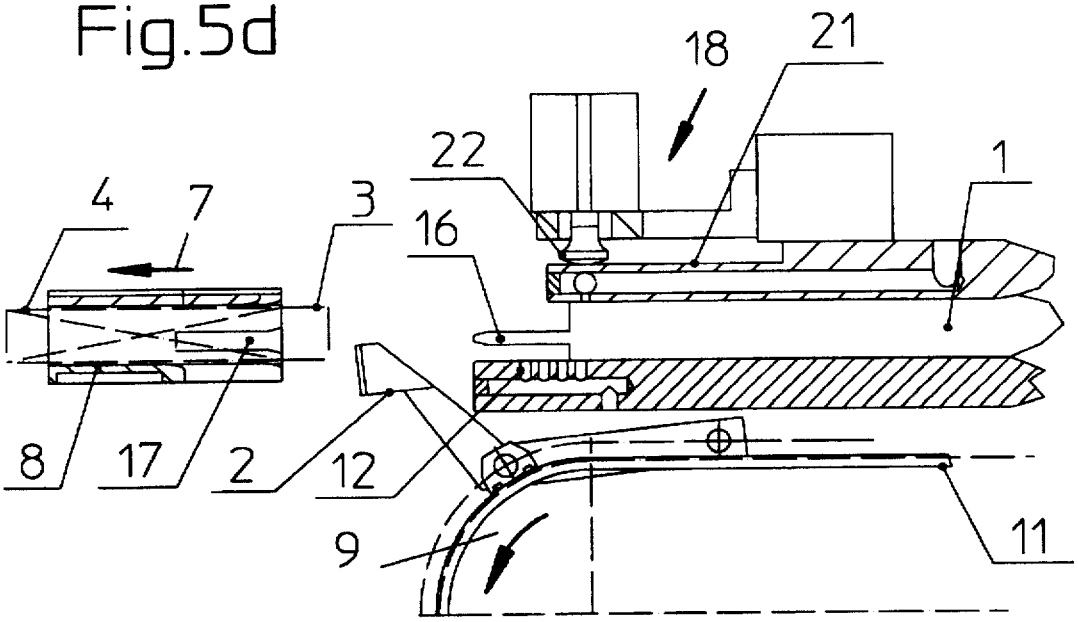
FIG. 5*d* shows the structure of FIG. 5*c* but with the receptacle and the pusher in different positions relative to the guide.

When the receptacle 8 reaches the maximum speed of its movement away from the guide 1, such speed exceeds the then speed of the pusher 2 so that the group 4 begins to move (with the receptacle) relative to the pusher and the latter no longer extends into the open rear or trailing end of the envelope 3. This renders it possible to move the pusher 9 along the arcuate path at the left-hand end turn of the conveyor 11 (see FIG. 5*d*). FIG. 5*d* further shows that the length of the receptacle 8 (as seen in the directions indicated by the double-headed arrow 7) can be less than that of a group 4 therein so that at least the trailing end of the envelope 3 can project from the receptacle and can be readily manipulated by the instrumentalities forming part of the packing machine but not forming part of the improved apparatus.

The next-following pusher 2 of the conveyor 11 then advances the next group 4 toward the discharge end of the path defined by the guide 1; also the receptacle 8 moves toward such discharge end in a manner as shown in FIG. 5*a*, and the same procedure is then repeated in order to transfer the next group into the pocket or receptacle. Each such group is held against movement forwardly and away from the respective pusher until it reaches the optimum position in the receptacle 8.

If the path which is defined by the guide 1 contains a group 19 which is defective or which is considered as being defective (e.g. because it is not partially confined in an envelope 3), the aforementioned sensor or sensors transmit one or more signals which cause the plunger 22 to descend and the suction ports 23 are connected to the suction generating device so that the braking device 18 is effective to arrest the group 19 in the guide 1, i.e., such group cannot enter the receptacle 8 or is caused to enter the receptacle in a position in which it can be expelled or removed from the receptacle rather than undergoing the treatment or manipulation required for the satisfactory groups 4.

It is clear that the connection between the suction ports 12 and the respective suction generating device can comprise one or more valves which are actuated to connect the ports 12 with the suction generating device only during certain stages of movement of successive pushers 2 toward and beyond the discharge end of the path which is defined by the guide 1. However, it has been found that the distribution of the suction ports 12 in the bottom wall and in the projections 13 can be readily selected in such a way that each satisfactory group 4 is subjected to an adequate braking action even if the just mentioned valve or valves are omitted or are not in actual use.

It is also possible to provide the apparatus with two or more receptacles 8 so that each of a series, of successive groups 4 is caused to enter a different receptacle.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating arrays of articles of the tobacco processing industry and, therefore, such adaptations should and are intended to be comprehended within the meaning and range of equivalence of the appended claims.

What is claimed is:

1. Apparatus for manipulating groups of articles of the tobacco processing industry, comprising a stationary guide defining a path for advancement of successive groups of a series of groups in a predetermined direction, said path having a discharge end; at least one receptacle for said groups, said receptacle being movable counter to said predetermined direction toward said discharge end to assume a group-receiving position and thereupon in said predetermined direction away from said discharge end; means for advancing successive groups of said series of groups along said path in said direction into and beyond said discharge end and into the receptacle while the receptacle assumes the group-receiving position; means for moving said advancing means at a plurality of speeds including a decreasing speed during introduction of groups into the receptacles at said discharge end; and means for braking the groups in said path at least during movement of said advancing means at said decreasing speed.

2. The apparatus of claim 1, wherein said groups include arrays of rod-shaped articles.

3. The apparatus of claim 1, wherein said advancing means comprises at least one pusher and said means for moving includes means for moving said at least one pusher along said path in said predetermined direction toward and beyond said discharge end.

4. The apparatus of claim 1, wherein said guide has at least one wall flanking said path and said braking means includes means for establishing a predetermined frictional engagement between said at least one wall and a group being engaged by said advancing means while the advancing means is moved at said decreasing speed.

5. The apparatus of claim 1, wherein said braking means comprises at least one suction port provided in said guide.

6. The apparatus of claim 5, wherein said guide includes a wall beneath said discharge end of said path and said at least one suction port is provided in said wall.

7. The apparatus of claim 1, wherein said path has a variable cross-sectional area at said discharge end thereof and said braking means includes means for varying said cross-sectional area of said path.

8. The apparatus of claim 7, wherein said guide includes a mobile wall above said discharge end of said path and said means for varying includes means for moving said wall relative to a group at said discharge end of said path.

9. The apparatus of claim 8, wherein said wall is elastically deformable.

10. The apparatus of claim 8, wherein said braking means further comprises at least one suction port in said wall.

11. The apparatus of claim 1, further comprising means for temporarily coupling said guide with the receptacle not later than when the receptacle completes its movement toward said discharge end.

12. The apparatus of claim 11, wherein said means for coupling comprises at least one projection provided on said guide at said discharge end of said path and a complementary recess provided in said at least one receptacle and receiving said at least one projection not later than upon completion of movement of the receptacle toward said discharge end.

13. The apparatus of claim 12, wherein said guide has a wall beneath said discharge end and said at least one projection is provided on said wall.

14. The apparatus of claim 13, wherein said braking means comprises at least one suction port provided in said at least one projection.

15. The apparatus of claim 11, wherein said guide includes a first wall disposed beneath said discharge end and at least one second wall laterally adjacent said discharge end, said coupling means comprising at least one projection provided on at least one of said walls and extending into a recess of said at least one receptacle not later than when the receptacle completes its movement toward said discharge end.

16. The apparatus of claim 1, wherein said braking means comprises a plurality of braking devices.

17. The apparatus of claim 16, wherein said devices include at least one pneumatic and at least one mechanical braking device.

18. The apparatus of claim 1, further comprising means for arresting selected groups of articles in said path to prevent the transfer of such selected groups into said at least one receptacle.

19. The apparatus of claim 1, wherein said braking means comprises means for preventing advancement of groups by inertia away from and out of contact with said advancing means during movement of said advancing means at said decreasing speed.

* * * * *